US007423001B2

(12) United States Patent
Jaynes

(10) Patent No.: US 7,423,001 B2
(45) Date of Patent: Sep. 9, 2008

(54) SURFACE BRIGHTENING COMPOSITION

(75) Inventor: Bingham Scott Jaynes, New City, NY (US)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 467 days.

(21) Appl. No.: 10/985,113

(22) Filed: Nov. 10, 2004

(65) Prior Publication Data

US 2005/0101507 A1 May 12, 2005

Related U.S. Application Data

(60) Provisional application No. 60/519,208, filed on Nov. 12, 2003.

(51) Int. Cl.

| | |
|---|---|
| ***C11D 3/02*** | (2006.01) |
| ***C11D 3/00*** | (2006.01) |
| ***C11D 3/42*** | (2006.01) |
| ***C11D 9/20*** | (2006.01) |
| ***C11D 17/04*** | (2006.01) |

(52) U.S. Cl. ..... 510/108; 510/307; 510/325; 510/356; 510/395; 510/400; 510/421; 510/438; 510/466; 510/475

(58) Field of Classification Search ..... 510/438, 510/108, 307, 325, 356, 395, 400, 421, 466, 510/475; 442/130

See application file for complete search history.

(56) References Cited

U.S. PATENT DOCUMENTS

| | | | | |
|---|---|---|---|---|
| 3,970,594 | A * | 7/1976 | Claybaugh | 510/438 |
| 4,309,316 | A * | 1/1982 | Lange et al. | 510/326 |
| 5,234,617 | A | 8/1993 | Hunter et al. | 252/102 |
| 6,340,663 | B1 | 1/2002 | Deleo et al. | 510/438 |
| 2003/0020046 | A1 | 1/2003 | Leyrer et al. | 252/301.21 |
| 2007/0054827 | A1 * | 3/2007 | Cheung | 510/238 |

FOREIGN PATENT DOCUMENTS

| | | |
|---|---|---|
| GB | 2359818 | 9/2001 |
| WO | 99/07636 | 2/1999 |

* cited by examiner

*Primary Examiner*—Lorna M. Douyon
*Assistant Examiner*—Jaison P Thomas
(74) *Attorney, Agent, or Firm*—Joseph C. Suhadolnik

(57) ABSTRACT

A surface cleaning composition is described comprising polyvinyl alcohol, at least one compound selected from the group consisting of the fluorescent whitening agents and at least one surfactant for use in delivering a whitening and brightening effect to a variety of surfaces. Such compositions can be applied directly to the surface or may be applied using a pre-treated wiping cloth or implement.

21 Claims, No Drawings

SURFACE BRIGHTENING COMPOSITION

This application claims benefit under 35 USC 119(e) of U.S. Provisional app. No. 60/519,208, filed Nov. 12, 2003.

The present invention relates to a surface cleaning composition, and in particular, to an aqueous surface cleaning composition which comprises polyvinyl alcohol, at least one fluorescent whitening agent and a suitable surfactant. The present invention also relates to reusable or disposable wipes or pads impregnated with said composition. The composition provides an enhanced whitening and brightening effect on surfaces.

TECHNICAL FIELD

Background of the Invention

Surface cleaning compositions are well known and presented as many different formulations depending upon the particular application and use. Surface cleaning compositions may, for example, be provided as ready-to-use compositions or as concentrates that are diluted before use; as liquid sprayable formulations, cream formulations, or in disposable wipe form. Surface cleaners may be used, for example, to clean surfaces in the kitchen, bathroom or other areas, either indoors or outdoors. Surfaces may include floors, tiles, glass, ceramic, enamel, appliances, stone, brick, plastic, vinyl, painted surfaces, and the like.

Optical brighteners (or fluorescent whitening agents, FWA's) are dyes that are deposited onto fabrics, paper, or other materials and impart an added increment of whiteness and/or brightness to the surface by means of their ability to absorb light in the ultraviolet region of the spectrum and re-emit it as visible light in the blue region of the visible spectrum. FWA's have found widespread use as components of household detergent compositions, but limited application in surface cleaning formulations.

GB 2,359,818 discloses the incorporation of FWA's into hard surface cleaning formulations.

U.S. Pat. No. 5,234,617 teaches a liquid bleach composition containing FWA and polyvinyl pyrrolidone.

WO 99/07636 claims the incorporation of FWA's into bleach containing compositions.

It has now been found that a fluorescent whitening agent, combined with polyvinyl alcohol and a suitable surfactant in aqueous solution, delivers an improved whitening and brightening effect on a variety of surfaces.

DETAILED DISCLOSURE

The present invention relates to an aqueous surface cleaning composition comprising water and by weight, based on the weight of the entire composition, a) from about 0.1% to about 20% of soluble polyvinyl alcohol (PVOH) with an average molecular weight of between about 5,000 and about 200,000, and hydrolysis level of between about 70 and about 100%, b) from about 0.01% to about 10% at least one compound selected from the group consisting of the fluorescent whitening agents and c) from about 0.001% to about 10% of at least one compound selected from the group consisting of the surfactants, wherein the weight:weight ratio of a) to b) is between about 20:1 and about 1:10 and the pH of the composition is between about 1 and about 11.

The bulk of the remainder of the composition is water. The composition may also contain a variety of other optional ingredients known to be used in surface cleaning or polishing formulations such as surfactants, builders, polymers, solvents, alcohols, glycols, metal salts, acids, bases, rheology modifiers, perfumes, dyes, abrasives, bleaches, biocides, fungicides, and the like.

Compositions of the present invention are useful for cleaning, whitening and brightening a variety of hard surfaces, soft surfaces (e.g. fabrics), or other substrates. The composition may be applied as a ready-to-use spray, liquid or paste, directly on the surface, which is then wiped using a paper towel, sponge, cloth, mop or other suitable wiping implement. Alternatively the composition may be applied first to the wiping implement and then to the surface. The composition may also be used in a dilutable form, that is a concentrate may be diluted with water to arrive at the present cleaning composition. In a preferred application, the composition may be added to a wipe or pad, either reusable or disposable, that is then used to treat the surface by wiping. The composition is absorbed into or adsorbed onto the wipe or pad, that is to say, the wipe or pad is impregnated with the aqueous cleaning composition. Such a wipe may be constructed of natural or synthetic fibers, for example cellulosic, polyolefin, woven or non-woven fibers, or any other material or combination of materials suitable for making a wiping cloth as is known by those skilled in the art. Such wiping cloths typically are constructed out of non-woven type materials. Polyolefin is for example polypropylene or polypropylene copolymers or blends. Cellulosic means cellulose-based.

Accordingly, also disclosed is a reusable or disposable wipe or pad for cleaning a surface, which wipe or pad has absorbed therein or adsorbed thereto an aqueous surface cleaning composition comprising water and by weight, based on the weight of the entire composition, a) from about 0.1% to about 20% of soluble polyvinyl alcohol (PVOH) with an average molecular weight of between about 5,000 and about 200,000, and hydrolysis level of between about 70 and about 100%, b) from about 0.01% to about 10% at least one compound selected from the group consisting of the fluorescent whitening agents and c) from about 0.001% to about 10% of at least one compound selected from the group consisting of the surfactants, wherein the weight:weight ratio of a) to b) is between about 20:1 and about 1:10 and the pH of the composition is between about 1 and about 11.

Wipes and pads are well known in the art. They are taught for example in U.S. Pat. Nos. 3,965,519, 3,967,623, 4,077,410, 4,154,883 and 5,895,504, the disclosures of which are hereby incorporated by reference. Other wiping implements are within the scope of this invention, for example sponges, mops and the like.

Disclosed is a cleaning composition concentrate comprising by weight, based on the weight of the concentrate, a) from about 0.25% to about 50% of soluble polyvinyl alcohol (PVOH) with an average molecular weight of between about 5,000 and about 200,000, and hydrolysis level of between about 70 and about 100%, b) from about 0.025% to about 25% at least one compound selected from the group consisting of the fluorescent whitening agents and c) from about 0.0025% to about 25% of at least one compound selected from the group consisting of the surfactants, wherein the weight:weight ratio of a) to b) is between about 20:1 and about 1:10.

Also disclosed is a method for providing an enhanced whitening and brightening effect to a surface, which method comprises applying the present aqueous surface cleaning composition to said surface, or applying the cleaning composition to a wiping implement and subsequently to the surface, and wiping the surface with a wiping implement.

Disclosed is a method for providing an enhanced whitening and brightening effect to a surface, which method comprises diluting a concentrate with water to arrive at the present aqueous cleaning composition, applying the cleaning composition to said surface, or applying the cleaning composition to a wiping implement and subsequently to the surface, and wiping the surface with a wiping implement.

Disclosed is a method for providing an enhanced whitening and brightening effect to a surface, which method comprises wiping the surface with a reusable or disposable wipe or pad, which wipe or pad has absorbed therein or adsorbed thereto the present cleaning composition.

Disclosed is a method of preparing a reusable or disposable wipe or pad useful for providing an enhanced whitening and brightening effect to a surface, which method comprises impregnating in or applying to a wipe or pad a present aqueous cleaning composition.

While not wishing to be bound by theory, it is believed that the present invention creates an optimized whitening and brightening effect on a surface because of the uniform distribution of FWA throughout the PVOH film that is deposited on the surface being cleaned. The surfactant increases the whitening effect by causing a more uniform film to be formed on the surface. The combined effect of all three components is significantly superior to FWA alone or FWA and PVOH alone.

Polyvinyl Alcohol

The polyvinyl alcohol (PVOH) in the present invention is a water-soluble polymer that is typically dissolved in water by heating to 50-95° C. for 10-120 minutes. Suitable grades of polyvinyl alcohol include materials of molecular weight between about 5,000 and about 200,000 and hydrolysis levels of between about 70% to about 100%. It has been found in the present invention that the whitening effect is increased with PVOH that is of higher molecular weight and lower hydrolysis. Thus the preferred grade has an average molecular weight of between about 50,000 and about 200,00 and hydrolysis level between about 70 and about 95%. In a particularly preferred embodiment, the PVOH has an average molecular weight of between about 85,000 and about 200,000 and hydrolysis level of between about 75 and about 90%.

In addition to increased whitening effects, the present grades of PVOH listed above are found to result in a whitening effect that is more stable with respect to degradation caused by light, oxidation or other degradation processes versus other grades of PVOH.

Other polymers may be added to the composition of any structural type or amount as long as they do not negatively affect the whitening and brightening effect of the composition as described.

The PVOH component is present from about 0.1% to about 20% by weight, based on the weight of the entire composition. For instance, the PVOH component is present from about 0.2% to about 15%, from about 0.3% to about 12%, from about 0.5% to about 10%, or from about 0.6% to about 9%, based on the weight of the entire composition. For example, the PVOH component is present from about 0.6% to about 5%, from about 0.6% to about 4% or from about 0.6% to about 3% by weight, based on the weight of the composition.

Fluorescent Whitening Agents (FWA's)

Any of various FWA's, or optical brighteners, known in the art may be used in the present invention. Two or more FWA's may also be combined in a given composition. Examples of FWA's that may be used in the present invention are stilbene derivatives, such as 4,4'-bis(triazine-2-ylamino)stilbene-2,2'-disulfonic acid, mono(azol-2-yl)stilbene and bis(azol-2-yl) stilbene; styryl derivatives of benzene and biphenyl, such as 1,4-bis(styryl)benzene, 4,4'-bis(styryl)benzene, 4,4'-bis-(styryl)biphenyl, 4,4'-bis(2-sulfostyryl)biphenyl sodium salt; pyrazolines such as 1,3-diphenyl-2-pyrazoline; bis(benzene-2-yl) derivatives; bis(benzoxazol-2-yl derivatives and bis (benzimidazole-2-yl) derivatives; 2-(benzofuran-2-yl) benzimidazole; coumarins such as 4-methyl-7-hydroxy-coumarin or 4-methyl-7-diethylaminocoumarin; carbostyrils; naphthalimides; dibenzothiophene-5,5-dioxide; pyrene; or pyridotriazole derivatives.

The FWA component is present from about 0.01% to about 10% by weight, based on the weight of the entire composition. For example, the FWA component is present from about 0.05% to about 8%, from about 0.1% to about 7%, from about 0.3% to about 5% by weight, based on the weight of the composition. For instance, the FWA component is present from about 0.3% to about 4%, from about 0.3% to about 3%, from about 0.3 to about 2%, or from about 0.3% to about 1% by weight, based on the weight of the composition.

Surfactants

The surfactant provides suitable film forming properties to allow the formation of a homogeneous film of PVOH and FWA on the surface being treated.

The surfactants are water soluble or water dispersable. The surfactants are well known in the art.

A surfactant used in the present invention may be selected from one or more surfactants, which may be anionic, cationic, non-ionic, amphoteric or zwitterionic surface active agents.

Non-ionic surfactants that may be used in the present invention include but are not limited to alkoxylated alcohols, including ethoxylated and propoxylated alcohols, as well as ethoxylated and propoxylated alkyl phenols. Other classes include sorbitan fatty esters and fatty acids of unsaturated alcohols. Other classes include fluorosurfacants such as the ZONYL family from Dupont, or silicone based surfactants such as the SILWET and COATOSIL families from General Electric. ZONYL, SILWET and COATOSIL type surfactants are also available in anionic and cationic versions that can also be effective in the present invention. DYNOL 604 is a useful surfactant, 2,5,8,11-tetramethyl-6-dodecyn-5,8-diol ethoxylate, CAS# 169117-72-0.

Examples of anionic surfactants that may be used in the present invention include but are not limited to alkali metal salts, ammonium salts, amine salts, aminoalcohol salts or the magnesium salts of one or more of the following compounds: alkyl sulfates, alky ether sulfates, alkylamidoether sulfates, monoglyceride sulfates, alkylsulfonates, alkylamide sulfonates, alkylarylsulfonates, olefinsulfonates, paraffin sulfonates, alkyl sulfosuccinates, alky ether sulfosuccinates, alkyl phosphates, alkyl ether phosphates, and similar compounds.

Amphoteric and betaine surfactants can be used in the present invention, as are known to those skilled in the art.

Cationic surfactants that may be used in the present invention include quaternary ammonium compounds and salts thereof, including alkyl ammonium halides, alkyl aryl ammonium halides, N-alkyl pyridinium halides, and related materials.

A mixture of two or more surface active agents may also be used. Other known surface active agents not particularly described above may also be used.

Useful surfactants are described for example in U.S. Pat. No. 6,372,702, hereby incorporated by reference.

The surfactant component is present from about 0.001% to about 10% by weight, based on the weight of the entire composition. For instance, the surfactant component is present from about 0.005% to about 8%, from about 0.01% to about 7%, from about 0.05% to about 6%, from about 0.07% to about 5%, or from about 0.8% to about 4% by weight, based on the composition. For example, the surfactant component is present from about 0.1% to about 3% by weight, based on the weight of the composition.

The weight:weight ratio of PVOH:FWA, that is component a) to component b), is between about 20:1 and about 1:10. For example, the weight:weight ratio of PVOH:FWA is between about 10:1 to about 1:5, between about 5:1 to about 1:1 or between about 4:1 to about 2:1.

The pH of the compositions of this invention is for example between about 1 and about 11, for instance between about 2 and about 10, between about 3 and about 9, between about 4 and about 8 or between about 5 and about 7.

EXAMPLES

In the following examples, the whiteness of ceramic tiles is measured using a Hunter Laboratories LabScan XE Colorimeter. The whiteness is expressed in terms of CIE Whiteness Index, defined as $Y+800(x_n-x)+1700(y_n-y)$, where Y is the tristimulus value and x and y are the chromaticity coordinates. For each treated tile, the Whiteness Index (WI) is measured on the treated and untreated (control) side of the tile and the difference is recorded. WI values are generally found to correspond well with what the human observer sees as whiteness or brightness. Unless indicated otherwise, amounts are in weight percent based on the entire formulation.

FWA is a distyrylbiphenyl type whitener, 4,4'-bis(2-sulfostyryl)biphenyl sodium salt,

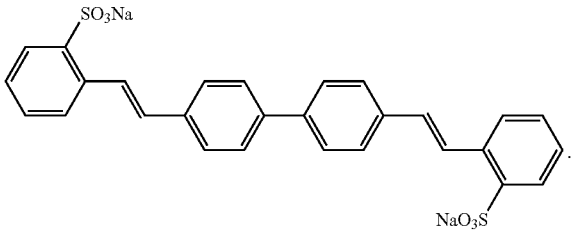

Example 1

A series of five polyvinyl alcohol samples of varying molecular weight and hydrolysis level are used to prepare 1.5% solutions (by weight). The solutions are prepared by adding an appropriate amount of PVOH solid to de-ionized water and heating the slurry of the solid polymer to ~80° C. for about 30 minutes until fully dissolved. The types of PVOH employed are listed below. The solution is then cooled. To 9.95 g of each PVOH solution is added 0.050 g of FWA (0.5% by weight) and the mixture is stirred until dissolved. An additional sample is prepared with FWA in water alone.

A second set of identical solutions is then prepared with the further addition of 0.5% by weight of a non-ionic Gemini-type surfactant (1:1 mixture of Surfynol® 485W and Dynol® 604, ethoxylated alkyne diol surfactants commercially available from Air Products and Chemicals, Inc.)

Glossy white ceramic tiles (10 cm×10 cm) are treated on one half with the solutions above by adding 0.75 mL to the surface of the tile and wiping for 20 seconds with a folded paper towel until the solution is evenly dispersed on half of the tile surface. The solution is then allowed to air dry and the two sides are measured using the calorimeter. The difference in whiteness index (WI) value between the treated and untreated side of each tile is then measured. K=1000.

| | Difference in Whiteness, Treated vs. Untreated Side | |
|---|---|---|
| Type of PVOH | No Surfactant | With Non-ionic Surfactant |
| None | 0 | 7.8 |
| MW = 120K avg hydrolysis = >99.3% | 32.4 | 42.3 |
| MW = 16K avg hydrolysis = 98% | 20.1 | 32.1 |
| MW = 95K avg hydrolysis = 95% | 36.0 | 44.3 |
| MW = 85-146K hydrolysis = 87-89% | 45.5 | 49.3 |
| MW = 13-23K hydrolysis = 87-89% | 11.6 | 28.3 |

PVOH samples of high molecular weight gives better whitening performance vs. those with low molecular weight. In addition, for those PVOH samples with similar molecular weight, those with lower hydrolysis levels gives better whitening. Finally, it can be seen that addition of non-ionic surfactant resulted in a significant improvement in the effect versus the same solution without surfactant.

Example 2

To a piece of nonwoven fabric (15 cm×15 cm) comprised of 50% rayon and 50% polyester with a thickness of 28 mil is added 3 mL of solution containing 1.5% PVOH (MW 85,000-146,000, 87-89% hydrolysed), 0.5% FWA and 0.5% non-ionic Gemini-type surfactant, as prepared in Example 1. The non-woven fabric is gently rolled until the solution completely and evenly wets the fabric. The fabric is then used to wipe a ceramic tile by wiping back and forth on one half of the tile surface for 20 seconds. The surface is then allowed to air dry and the tile is measured using the colorimeter.

Treatment of the tile with the impregnated wiping cloth resulted in a significant and visible increase in whiteness, and a measured increase in the Whiteness Index of 48.9 units versus the control side.

Example 3

To a series of solutions of 1.5% PVOH (avg. MW 120,000; 99.3% hydrolysed) and 0.5% FWA are added three different silicone based surfactants at a level of 0.1%. Glossy ceramic tiles are treated as described in Example 1 and the WI values are recorded for the treated and untreated sides of each tile, as illustrated in the table below.

| | WI, control side | WI, treated side | Change in WI |
|---|---|---|---|
| 1.5% PVOH<br>0.5% FWA<br>no surfactant | 60.9 | 84.0 | 23.1 |
| 1.5% PVOH<br>0.5% FWA<br>0.1%<br>COATOSIL 1211 | 62.7 | 91.8 | 29.1 |
| 1.5% PVOH<br>0.5% FWA<br>0.1%<br>COATOSIL 1301 | 61.2 | 88.9 | 27.7 |
| 1.5% PVOH<br>0.5% FWA<br>0.1% SILWET L-7608 | 59.8 | 89.2 | 29.4 |

The addition of silicone based surfactant results in a significant increase in whiteness on the treated side of the tile versus solutions without surfactant.

The COATOSIL and SILWET products (GE Chemicals) are silicone wetting agents that include dimethylpolysiloxane, and blocked or grafted polymers of alkylene glycols as effective components.

Example 4

Two solutions are prepared with 1.5% PVOH (MW 85,000-146,000, 87-89% hydrolysed), 0.5% FWA, and 0.2% by weight of either Dynol® 604 (Air Products) or Coatosil® 1301 (GE Silicones). White vinyl floor tiles (7 cm×14 cm, Armstrong Tile) are treated on one half with the solutions above by adding 0.50 mL to the surface of the tile and wiping for 20 seconds with a folded paper towel until the solution is evenly dispersed on half of the tile surface. The solution is then allowed to air dry. The difference in whiteness index (WI) value between the treated and untreated side of each tile is then measured.

| | WI, control side | WI, treated side | Change in WI |
|---|---|---|---|
| 1.5% PVOH<br>0.5% FWA<br>0.2%<br>Dynol ® 604 | 85.8 | 107.5 | 21.7 |
| 1.5% PVOH<br>0.5% FWA<br>0.2%<br>COATOSIL 1301 | 86.0 | 112.5 | 26.5 |

The treated sides of the tiles were visibly whiter and had substantially higher WI values than the untreated sides.

What is claimed is:

1. An aqueous surface cleaning composition comprising water and by weight, based on the weight of the entire composition, a) from about 0.1% to about 20% of soluble polyvinyl alcohol (PVOH) with an average molecular weight of between about 85,000 and 146,000, and hydrolysis level of between about 75% and about 90, b) from about 0.01% to about 10% at least one compound selected from the group consisting of the fluorescent whitening agents and c) from about 0.001% to about 10% of at least one compound selected from the group consisting of the non-ionic surfactants selected from the group consisting of the alkoxylated alcohols and silicone based surfactants, wherein the weight:weight ratio of a) to b) is between about 20:1 and about 1:10 and the pH of the composition is between about 1 and about 11.

2. A composition according to claim 1 where the polyvinyl alcohol is present from about 0.5% to about 10% by weight, based on the weight of the entire composition.

3. A composition according to claim 1 where the polyvinyl alcohol is present from about 0.6% to about 4% by weight, based on the weight of the entire composition.

4. A composition according to claim 1 where the fluorescent whitening agents are selected from the group consisting of the stilbene derivatives, the styryl derivatives of benzene and biphenyl, the pyrazolines, the bis(benzene-2-yl) derivatives, the bis(benzoxazol-2-yl derivatives and bis(benzimidazole-2-yl) derivatives, 2-(benzofuran-2-yl) benzimidazole, the coumarins, the carbostyrils, the naphthalimides, dibenzothiophene-5,5-dioxide, pyrene and the pyridotriazole derivatives.

5. A composition according to claim 1 where the fluorescent whitening agents are selected from the group consisting of 4,4'-bis(triazine-2-ylamino)stilbene-2,2'-disulfonic acid, mono(azol-2-yl)stilbene, bis(azol-2-yl)stilbene, 1,4-bis (styryl)benzene, 4,4'-bis(styryl)benzene, 4,4'-bis-(styryl)biphenyl, 4,4'-bis(2-sulfostyryl)biphenyl sodium salt, 1,3-diphenyl-2-pyrazoline, 2-(benzofuran-2-yl) benzimidazole, 4-methyl-7-hydroxy-coumarin, 4-methyl-7-diethylaminocoumarin, dibenzothiophene-5,5-dioxide and pyrene.

6. A composition according to claim 1 where the fluorescent whitening agents are selected from the group consisting of 4,4'-bis(triazine-2-ylamino)stilbene-2,2'-disulfonic acid, 4,4'-bis(styryl)benzene, 4,4'-bis-(styryl)biphenyl and 4,4'-bis (2-sulfostyryl)biphenyl sodium salt.

7. A composition according to claim 1 where the fluorescent whitening agents are present from about 0.1% to about 7% by weight, based on the weight of the entire composition.

8. A composition according to claim 1 where the fluorescent whitening agents are present from about 0.3% to about 2% by weight, based on the weight of the entire composition.

9. A composition according to claim 1 where the surfactants are present from about 0.01% to about 7% by weight, based on the weight of the entire composition.

10. A composition according to claim 1 where the surfactants are present from about 0.05% to about 6% by weight, based on the weight of the entire composition.

11. A composition according to claim 1 where the weight: weight ratio of polyvinyl alcohol:fluorescent whitening agents is from about 10:1 to about 1:5.

12. A composition according to claim 1 where the weight: weight ratio of polyvinyl alcohol:fluorescent whitening agents is from about 5:1 to about 1:1.

13. A reusable or disposable wipe or pad for cleaning a surface, which wipe or pad which has absorbed therein or adsorbed thereto an aqueous surface cleaning composition comprising water and by weight, based on the weight of the entire composition, a) from about 0.1% to about 20% of soluble polyvinyl alcohol (PVOH) with an average molecular weight of between about 85,000 and 146,000, and hydrolysis level of between about 75% and about 90%, b) from about 0.01% to about 10% at least one compound selected from the group consisting of the fluorescent whitening agents and c) from about 0.001% to about 10% of at least one compound selected from the group consisting of the non-ionic surfactants selected from the group consisting of the alkoxylated alcohols and silicone based surfactants, wherein the weight:weight ratio of a) to b) is between about 20:1 and about 1:10 and the pH of the composition is between about 1 and about 11.

14. A wipe or pad according to claim 13 which comprises cellulosic, polyolefin, woven or non-woven fibers.

15. A wipe or pad according to claim 13 which comprises cellulosic or polyolefin non-woven fibers.

16. An aqueous cleaning composition concentrate comprising by weight, based on the weight of the concentrate, a) from about 0.25% to about 50% of soluble polyvinyl alcohol (PVOH) with an average molecular weight of between about 85,000 and 146,000, and hydrolysis level of between about 75% and about 90%, b) from about 0.025% to about 25% at least one compound selected from the group consisting of the fluorescent whitening agents and c) from about 0.0025% to about 25% of at least one compound selected from the group consisting of the non-ionic surfactants selected from the group consisting of the alkoxylated alcohols and silicone based surfactants, wherein the weight:weight ratio of a) to b) is between about 20:1 and about 1:10.

17. A method of preparing a reusable or disposable wipe or pad useful for providing an enhanced whitening and brightening effect to a surface, which method comprises impregnating in or applying to a wipe or pad an aqueous cleaning composition according to claim 1.

18. A composition according to claim 1, wherein the alkoxylated alcohols are selected from alkoxylated alkynyl diols.

19. A composition according to claim 1, wherein the non-ionic surfactants are selected from the group consisting of the ethoxylated alkynyl diols.

20. A reusable or disposable wipe or pad for cleaning a surface, according to claim 13, wherein the alkoxylated alcohols are selected from alkoxylated alkynyl diols.

21. A reusable or disposable wipe or pad for cleaning a surface, according to claim 13, wherein the non-ionic surfactants are selected from the group consisting of the ethoxylated alkynyl diols.

* * * * *